US010165386B2

(12) United States Patent
Lehtiniemi et al.

(10) Patent No.: US 10,165,386 B2
(45) Date of Patent: Dec. 25, 2018

(54) VR AUDIO SUPERZOOM

(71) Applicant: Nokia Technologies Oy, Espoo (FI)

(72) Inventors: Arto Juhani Lehtiniemi, Lempaala (FI); Antti Johannes Eronen, Tampere (FI); Jussi Artturi Leppanen, Tampere (FI); Sujeet Shyamsundar Mate, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/596,533

(22) Filed: May 16, 2017

(65) Prior Publication Data

US 2018/0338213 A1 Nov. 22, 2018

(51) Int. Cl.

| | |
|---|---|
| ***H04R 5/02*** | (2006.01) |
| ***H04S 7/00*** | (2006.01) |
| ***H04R 3/00*** | (2006.01) |

(52) U.S. Cl.

CPC ..... *H04S 7/303* (2013.01); *H04R 3/005* (2013.01); *H04R 2430/20* (2013.01); *H04S 2400/11* (2013.01)

(58) Field of Classification Search

CPC .. H04S 7/303; H04S 2400/11; H04S 2420/01; H04S 1/002; H04R 3/005; H04R 2430/20

See application file for complete search history.

(56) References Cited

U.S. PATENT DOCUMENTS

| | | | |
|---|---|---|---|
| 6,330,486 | B1 | 12/2001 | Padula |
| 7,266,207 | B2 | 9/2007 | Wilcock et al. |
| 7,492,915 | B2 | 2/2009 | Jahnke |
| 8,187,093 | B2 | 5/2012 | Hideya et al. |
| 8,189,813 | B2 | 5/2012 | Muraoka et al. |
| 8,411,880 | B2 | 4/2013 | Wang et al. |
| 8,509,454 | B2 | 8/2013 | Kirkeby et al. |
| 8,831,255 | B2 | 9/2014 | Crawford et al. |
| 8,990,078 | B2 | 3/2015 | Nakadai et al. |

(Continued)

FOREIGN PATENT DOCUMENTS

| | | |
|---|---|---|
| EP | 2688318 A1 | 1/2014 |
| GB | 2540175 A | 1/2017 |

(Continued)

OTHER PUBLICATIONS

Anil Camci, Paul Murray, Angus Graeme Forbes, "*A Web-based UI for Designing 3D Sound Objects and Virtual Sonic Enviroments*" Electronic Visualization Laboratory, Department of Computer Science, University of Illinois at Chicago retrieved May 16, 2017.

(Continued)

*Primary Examiner* — Andrew L Sniezek

(74) *Attorney, Agent, or Firm* — Harrington & Smith

(57) ABSTRACT

A method including, identifying at least one object of interest (OOI), determining a plurality of microphones capturing sound from the at least one OOI, determining, for each of the plurality of microphones, a volume around the at least one OOI, determining a spatial audio volume based on associating each of the plurality of microphones to the volume around the at least one OOI, and generating a spatial audio scene based on the spatial audio volume for free-listening-point audio around the at least one OOI.

20 Claims, 9 Drawing Sheets

(56) References Cited

U.S. PATENT DOCUMENTS

| | | | | |
|---|---|---|---|---|
| 9,161,147 | B2 | 10/2015 | Korn | |
| 9,179,232 | B2 | 11/2015 | Jarske et al. | |
| 9,197,979 | B2 | 11/2015 | Lemieux et al. | |
| 9,215,539 | B2 | 12/2015 | Kim et al. | |
| 9,271,081 | B2 | 2/2016 | Corteel et al. | |
| 2002/0150254 | A1 | 10/2002 | Wilcock et al. | |
| 2006/0025216 | A1 | 2/2006 | Smith | |
| 2008/0144864 | A1 | 6/2008 | Huon | |
| 2008/0247567 | A1 | 10/2008 | Kjolerbakken et al. | |
| 2009/0262946 | A1 | 10/2009 | Dunko | |
| 2010/0098274 | A1 | 4/2010 | Hannemann et al. | |
| 2010/0119072 | A1* | 5/2010 | Ojanpera | G10L 19/008 381/17 |
| 2010/0208905 | A1 | 8/2010 | Franck et al. | |
| 2011/0002469 | A1 | 1/2011 | Ojala | |
| 2011/0129095 | A1 | 6/2011 | Avendano et al. | |
| 2011/0166681 | A1 | 7/2011 | Lee et al. | |
| 2012/0027217 | A1 | 2/2012 | Jun et al. | |
| 2012/0230512 | A1 | 9/2012 | Ojanpera | |
| 2012/0232910 | A1 | 9/2012 | Dressler et al. | |
| 2013/0114819 | A1 | 5/2013 | Melchior et al. | |
| 2013/0259243 | A1 | 10/2013 | Herre et al. | |
| 2013/0321586 | A1 | 12/2013 | Kirk et al. | |
| 2014/0010391 | A1 | 1/2014 | Ek et al. | |
| 2014/0133661 | A1 | 5/2014 | Harma et al. | 381/22 |
| 2014/0285312 | A1 | 9/2014 | Laaksonen et al. | |
| 2014/0328505 | A1 | 11/2014 | Heinemann et al. | |
| 2014/0350944 | A1 | 11/2014 | Jot et al. | |
| 2015/0002388 | A1 | 1/2015 | Weston et al. | |
| 2015/0003616 | A1 | 1/2015 | Middlemiss et al. | |
| 2015/0055937 | A1 | 2/2015 | Van Hoff et al. | |
| 2015/0063610 | A1 | 3/2015 | Mossner | |
| 2015/0078594 | A1 | 3/2015 | Mcgrath et al. | 381/300 |
| 2015/0116316 | A1 | 4/2015 | Fitzgerald et al. | |
| 2015/0146873 | A1 | 5/2015 | Chabanne et al. | 7/305 |
| 2015/0223002 | A1 | 8/2015 | Mehta et al. | 7/30 |
| 2015/0263692 | A1 | 9/2015 | Bush | |
| 2015/0302651 | A1 | 10/2015 | Shpigelman | |
| 2015/0316640 | A1 | 11/2015 | Jarske et al. | |
| 2016/0084937 | A1 | 3/2016 | Lin | |
| 2016/0112819 | A1 | 4/2016 | Mehnert et al. | |
| 2016/0125867 | A1 | 5/2016 | Jarvinen et al. | |
| 2016/0142830 | A1 | 5/2016 | Hu | |
| 2016/0150267 | A1 | 5/2016 | Strong | |
| 2016/0150345 | A1 | 5/2016 | Jang | |
| 2016/0192105 | A1 | 6/2016 | Breebaart et al. | |
| 2016/0212272 | A1 | 7/2016 | Srinivasan et al. | |
| 2016/0227337 | A1 | 8/2016 | Goodwin et al. | |
| 2016/0227338 | A1 | 8/2016 | Oh et al. | |
| 2016/0266865 | A1 | 9/2016 | Tsingos et al. | |
| 2016/0300577 | A1 | 10/2016 | Fersch et al. | |
| 2016/0313790 | A1 | 10/2016 | Clement et al. | |
| 2017/0077887 | A1 | 3/2017 | You | |
| 2017/0110155 | A1 | 4/2017 | Campbell et al. | |
| 2017/0150252 | A1 | 5/2017 | Trestain et al. | |
| 2017/0165575 | A1 | 6/2017 | Ridihalgh et al. | |
| 2017/0169613 | A1 | 6/2017 | VanBlon et al. | |
| 2017/0230760 | A1* | 8/2017 | Sanger | H04R 25/40 |
| 2017/0295446 | A1 | 10/2017 | Thagadur Shivappa | |
| 2017/0366914 | A1 | 12/2017 | Stein et al. | |

FOREIGN PATENT DOCUMENTS

| | | | |
|---|---|---|---|
| WO | WO-2011/020067 | A1 | 2/2011 |
| WO | WO-2011020065 | A1 | 2/2011 |
| WO | WO-2013/064943 | A1 | 5/2013 |
| WO | WO-2014168901 | A1 | 10/2014 |
| WO | WO-2015/152661 | A1 | 10/2015 |
| WO | WO-2016014254 | A1 | 1/2016 |
| WO | WO-2017120681 | A1 | 7/2017 |

OTHER PUBLICATIONS

Cameron Faulkner, "*Google's Adding Immersive Audio to your Virtual Reality Worlds*" http://www.in.techradar.com/news/misc/googlesaddingimmersiveaudiotoyourvrworlds/articleshow/57191578.cms retrieved Feb. 16, 2017.

Hatala, Marek et al., "Ontology-Based User Modeling in an Augmented Audio Reality System for Museums", http://citeseerx.ist.psu.edu/viewdoc/download?doi=10.1.1.91.5712&rep=rep1&type=pdf; Aug. 29, 2016, 38 pgs.

Gunel, Banu et al., "Spatial Synchronization of Audiovisual Objects by 3D Audio Object Coding", IEEE 2010, pp. 460-465; https://www.researchgate.net/profile/E_Ekmekcioglu/publication/251975482_Spatial_synchronization_of _audiovisual_objects_by_3D_audio_object_coding/links/54e783660cf2f7aa4d4d858a.pdf >; 2010.

Galvez, Marcos F. Simon; Menzies, Dylan; Mason, Rusell; Fazi, Filippo Maria "Object-Based Audio Reproduction Using a Listener-Position Adaptive Stereo System" University of Southhampton <http://www.aes.org/e-lib/browse,cfm?elib=18516>.

Simon Galvez, Marcos F.; Menzies, Dylan; Fazi, Filippo Maria; de Campos, Teofilo; Hilton, Adrian "A Listener Position Adaptive Stereo System for Object-Based Reproduction" http://www.aes.org/e-lib/browse.cfm?elib=17670 dated May 6, 2015.

Micah T. Taylor, Anish Chandak, Lakulish Antani, Dinesh Manocha, "*RESound: Interactive Sound Rendering for Dynamic Virtual Enviroments*" MM'09, Oct. 19-24, 2009, Beijing, China. http://gamma.cs.unc.edu/Sound/RESound/.

Alessandro Pieropan, Giampiero Salvi, Karl Pauwels, Hedvig Kjellstrom Audio-Visual Classification and Detection of Human Manipulation Actions [https://www.csc.kth.se/-hedvig/publications/iros_14.pdf] retrieved Sep. 29, 2017.

Henney Oh "The Future of VR Audio-3 Trends to Track This Year" dated Jul. 4, 2017.

Carl Schissler, Aaron Nicholls, and Ravish Mehra "Efficient HRTF-Based Spatial Audio for Area and Volumetric Sources" [retrieved Jan. 31, 2018].

Hasan Khaddour, Jiri Schimmel, Frantisek Rund "A Novel Combined System of Direction Estimation and Sound Zooming of Multiple Speakers" Radioengineering, vol. 24, No. 2, Jun. 2015.

"Unity 3D Audio"; Nov. 8, 2011; whole document (9 pages).

Wozniewski, M. et al.; "User-Specific Audio Rendering and Steerable Sound for Distributed Virtual Environments"; Proceedings of the 13th International Conference on Auditory Display; Montréal, Canada; Jun. 26-29, 2007; whole document (4 pages).

Li, Loco Radio Designing High Density Augmented Reality Audio Browsers, PhD Thesis Final, MIT, 2014.

* cited by examiner

VR AUDIO SUPERZOOM

BACKGROUND

Technical Field

The exemplary and non-limiting embodiments relate generally to free-viewpoint virtual reality, object-based audio, and spatial audio mixing (SAM).

Brief Description of Prior Developments

Free-viewpoint audio generally allows for a user to move around in the audio (or generally, audio-visual or mediated reality) space and experience the audio space in a manner that correctly corresponds to his location and orientation in it. This may enable various virtual reality (VR) and augmented reality (AR) use cases. The spatial audio may consist, for example, of a channel-based bed and audio-objects, audio-objects only, or any equivalent spatial audio representation. While moving in the space, the user may come into contact with audio-objects, the user may distance themselves considerably from other objects, and new objects may also appear.

SUMMARY

The following summary is merely intended to be exemplary. The summary is not intended to limit the scope of the claims.

In accordance with one aspect, an example method comprises, identifying at least one object of interest (OOI), determining a plurality of microphones capturing sound from the at least one OOI, determining, for each of the plurality of microphones, a volume around the at least one OOI, determining a spatial audio volume based on associating each of the plurality of microphones to the volume around the at least one OOI, and generating a spatial audio scene based on the spatial audio volume for free-listening-point audio around the at least one OOI.

In accordance with another aspect, an example apparatus comprises at least one processor; and at least one non-transitory memory including computer program code, the at least one memory and the computer program code configured to, with the at least one processor, cause the apparatus to: identify at least one object of interest (OOI), determine a plurality of microphones capturing sound from the at least one OOI, determine, for each of the plurality of microphones, a volume around the at least one OOI, determine a spatial audio volume based on associating each of the plurality of microphones to the volume around the at least one OOI, and generate a spatial audio scene based on the spatial audio volume for free-listening-point audio around the at least one OOI.

In accordance with another aspect, an example apparatus comprises a non-transitory program storage device readable by a machine, tangibly embodying a program of instructions executable by the machine for performing operations, the operations comprising: identifying at least one object of interest (OOI), determining a plurality of microphones capturing sound from the at least one OOI, determining, for each of the plurality of microphones, a volume around the at least one OOI, determining a spatial audio volume based on associating each of the plurality of microphones to the volume around the at least one OOI, and generating a spatial audio scene based on the spatial audio volume for free-listening-point audio around the at least one OOI.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
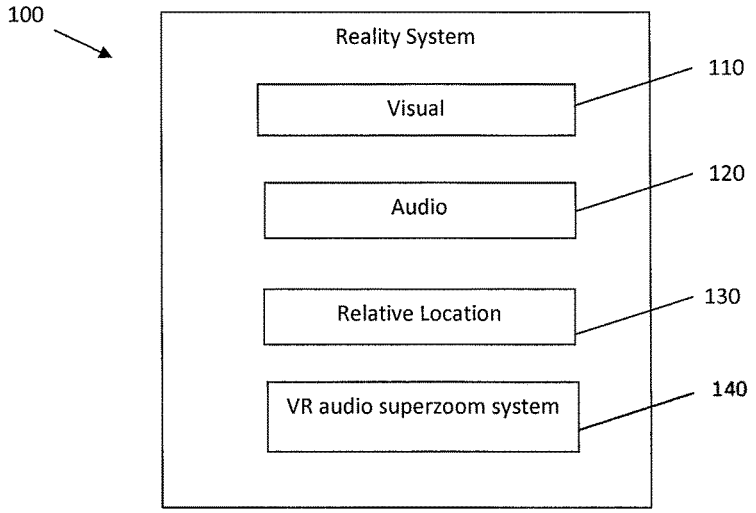
FIG. 1 is a diagram illustrating a reality system comprising features of an example embodiment.

Referring to FIG. 1, a diagram is shown illustrating a reality system 100 incorporating features of an example embodiment. The reality system 100 may be used by a user for augmented-reality (AR), virtual-reality (VR), or presence-captured (PC) experiences and content consumption, for example, which incorporate free-viewpoint audio. Although the features will be described with reference to the example embodiments shown in the drawings, it should be understood that features can be embodied in many alternate forms of embodiments.

The system 100 generally comprises a visual system 110, an audio system 120, a relative location system 130 and a VR audio superzoom system 140. The visual system 110 is configured to provide visual images to a user. For example, the visual system 12 may comprise a virtual reality (VR) headset, goggles or glasses. The audio system 120 is configured to provide audio sound to the user, such as by one or more speakers, a VR headset, or ear buds for example. The relative location system 130 is configured to sense a location of the user, such as the user's head for example, and determine the location of the user in the realm of the reality content consumption space. The movement in the reality content consumption space may be based on actual user movement, user-controlled movement, and/or some other externally-controlled movement or pre-determined movement, or any combination of these. The user is able to move in the content consumption space of the free-viewpoint. The relative location system 130 may be able to change what the user sees and hears based upon the user's movement in the real-world; that real-world movement changing what the user sees and hears in the free-viewpoint rendering.

The movement of the user, interaction with audio-objects and things seen and heard by the user may be defined by predetermined parameters including an effective distance parameter and a reversibility parameter. An effective distance parameter may be a core parameter that defines the distance from which user interaction is considered for the current audio-object. A reversibility parameter may also be considered a core parameter, and may define the reversibility of the interaction response. The reversibility parameter may also be considered a modification adjustment parameter. Although particular modes of audio-object interaction are described herein for ease of explanation, brevity and simplicity, it should be understood that the methods described herein may be applied to other types of audio-object interactions.

The user may be virtually located in the free-viewpoint content space, or in other words, receive a rendering corresponding to a location in the free-viewpoint rendering. Audio-objects may be rendered to the user at this user location. The area around a selected listening point may be defined based on user input, based on use case or content specific settings, and/or based on particular implementations of the audio rendering. Additionally, the area may in some embodiments be defined at least partly based on an indirect user or system setting such as the overall output level of the system (for example, some sounds may not be heard when the sound pressure level at the output is reduced).

VR audio superzoom system 140 may enable, in a free viewpoint VR environment, a user to isolate (for example, 'solo') and inspect more closely a particular sound source from a plurality of viewing points (for example, all the available viewing points) in a scene. VR audio superzoom system 140 may enable the creation of audio scenes, which may enable a volumetric audio experience, in which the user may experience an audio object at different levels of detail, and as captured by different devices and from different locations/directions. This may be referred as "immersive audio superzoom". VR audio superzoom system 140 may enable the creation of volumetric, localized, object specific audio scenes. VR audio superzoom system 140 may enable a user to inspect the sound of an object from different locations close to the object, and captured by different capture devices. This allows the user to hear a sound object in detail and from different perspectives. VR audio superzoom system 140 may combine the audio signals from different capture devices and create the audio scene, which may then be rendered to the user.

The VR audio superzoom system 140 may be configured to generate a volumetric audio scene relating to and proximate to a single sound object appearing in a volumetric (six-degrees-of-freedom (6DoF), for example) audio scene. In particular, VR audio superzoom system 140 may implement a method of creating localized and object specific audio scenes. VR audio superzoom system 140 may locate/find a plurality of microphones (for example, all microphones) that are capturing the sound of an object of interest and then create a localized and volumetric audio scene around the object of interest using the located/found microphones. VR audio superzoom system 140 may enable a user/listener to move around a sound object and listen to a sound scene comprising of only audio relating to the object, captured from different positions around the object. As a result, the user may be able to hear how the object sounds from different directions, and navigation may be done in a manner corresponding to a predetermined pattern (for example, an intuitive way based on user logic) by moving around the object of interest.

VR audio superzoom system 140 may enable "superzoom" type of functionality during volumetric audio experiences. VR audio superzoom system 140 may implement ancillary systems for detecting user proximity to an object and/or rendering the audio scene. VR audio superzoom system 140 may implement spatial audio mixing (SAM) functionality involving automatic positioning, free listening point changes, and assisted mixing operations.

VR audio superzoom system 140 may define the interaction area via local tracking and thereby enable stabilization of the audio-object rendering at a variable distance to the audio-object depending on real user activity. In other words, the response of the VR audio superzoom system 140 may be altered (for example, the response may be slightly different) each time, thereby improving the realism of the interaction. The VR audio superzoom system 140 may track the user's local activity and further enable making of intuitive decisions on when to apply specific interaction rendering effects to the audio presented to the user. VR audio superzoom system 140 may implement these steps together to significantly enhance the user experience of free-viewpoint audio where no or only a reduced set of metadata is available.

Figure 2:
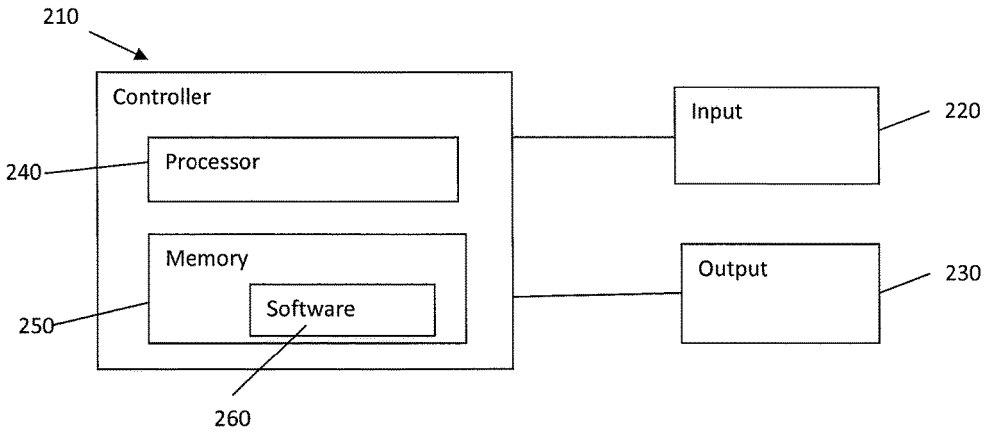
FIG. 2 is a diagram illustrating some components of the system shown in FIG. 1.

Referring also to FIG. 2, the reality system 100 generally comprises one or more controllers 210, one or more inputs 220 and one or more outputs 230. The input(s) 220 may comprise, for example, location sensors of the relative location system 130 and the VR audio superzoom system 140, rendering information for VR audio superzoom system 140, reality information from another device, such as over the Internet for example, or any other suitable device for inputting information into the system 100. The output(s) 230 may comprise, for example, a display on a VR headset of the visual system 110, speakers of the audio system 120, and a communications output to communication information to another device. The controller(s) 210 may comprise one or more processors 240 and one or more memory 250 having software 260 (or machine-readable instructions).

Figure 3:
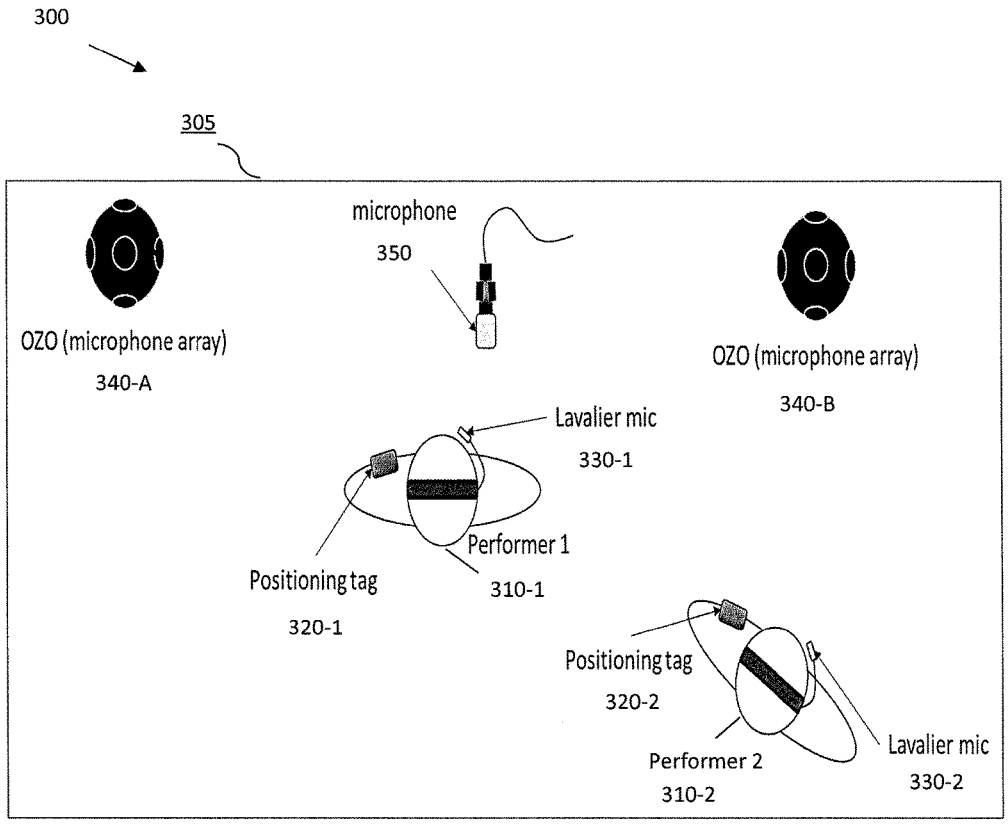
FIG. 3 is an example illustration of a scene with performers being recorded with multiple microphones.

Referring also to FIG. 3, an illustration 300 of a scene 305 with multiple performers being recorded with multiple microphones is shown.

As shown in FIG. 3, multiple performers (in this instance, two performers, performer 1 301-1 and performer 2 310-2, referred to singularly as performer 310 and in plural as performers 310) may be recorded with multiple microphones (and cameras) (shown in this instance microphone arrays 340-A and 340-B, such as a NOKIA OZO microphone array, and a microphone 350, for example a stage mic). In addition, each of the performers 310 may include an associated positioning tag (320-1 and 320-2) and lavalier microphone (330-1 and 330-2). (Information regarding) the performers 310 and microphone positions may be known/provided to VR audio superzoom system 140. Although FIG. 3 and subsequent discussions describe performers 310, it should be understood that these processes may be applied to any audio object.

Figure 4:
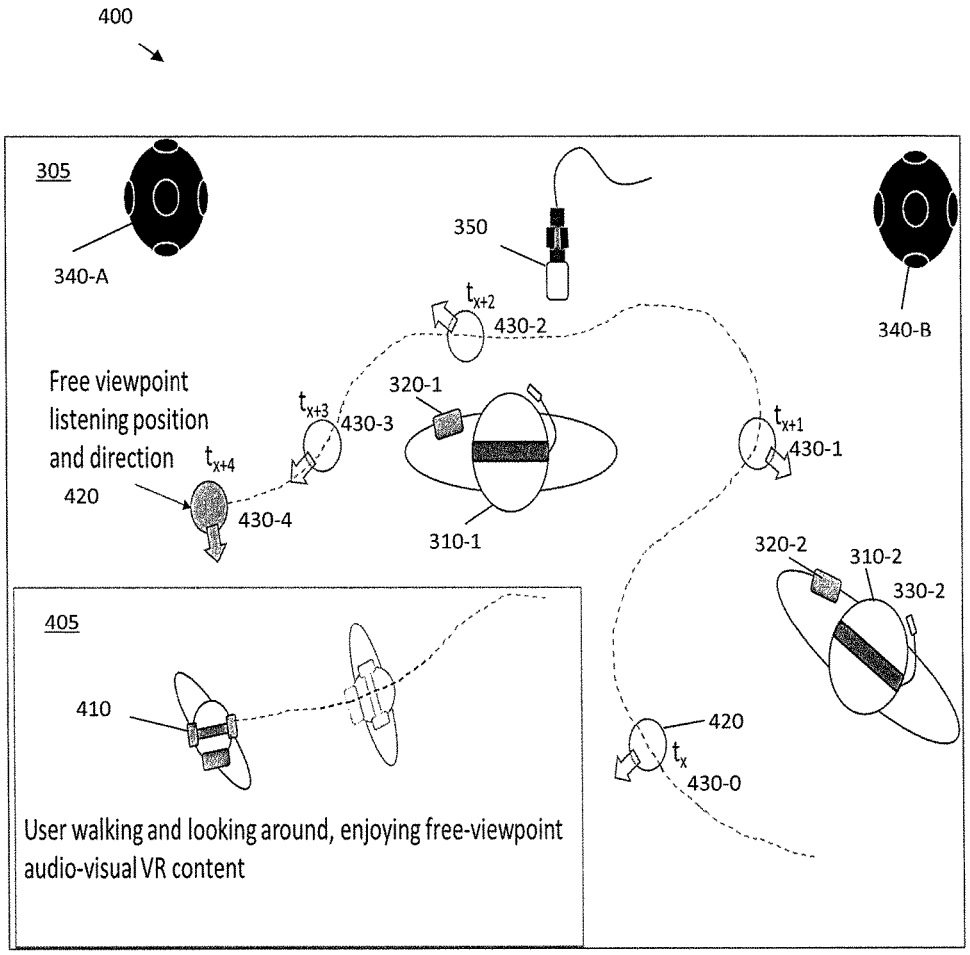
FIG. 4 is an example illustration of a user consuming VR content via free-viewpoint.

Referring also to FIG. 4, an example illustration 400 of a user consuming VR content via free-viewpoint is shown.

As shown in FIG. 4, a user 410 (in an environment 405 associated with scene 305) may enjoy the VR content captured by the cameras and microphones in a free-viewpoint manner. The user 410 may move (for example, walk) around the scene 305 (based on a free viewpoint listening position and direction 420 with the scene 305) and listen and see the performers from different (for example, any) angles at different times (shown by the examples tx, 430-0 to tx+4, 430-4 in FIG. 4).

FIGS. 3 and 4 illustrate an environment in which VR audio superzoom system 140 may be deployed/employed. Referring back to FIG. 3, a VR scene 305 may be recorded with multiple microphones and cameras. The positions of the performers 310 and the microphones may be known. The volumetric scene 305 may be determined/generated to be consumed in a free-viewpoint manner, in which the user 410 is able to move around the scene 305 freely. The user 410 may hear the performers 310 such that their directions and distances to the user 410 are taken into account in the audio rendering (FIG. 4). For example, when the user 410 (within the VR scene 305) moves away from a performer 310, the audio for that performer 310 may thereby become quieter and more reverberant.

Figure 5:
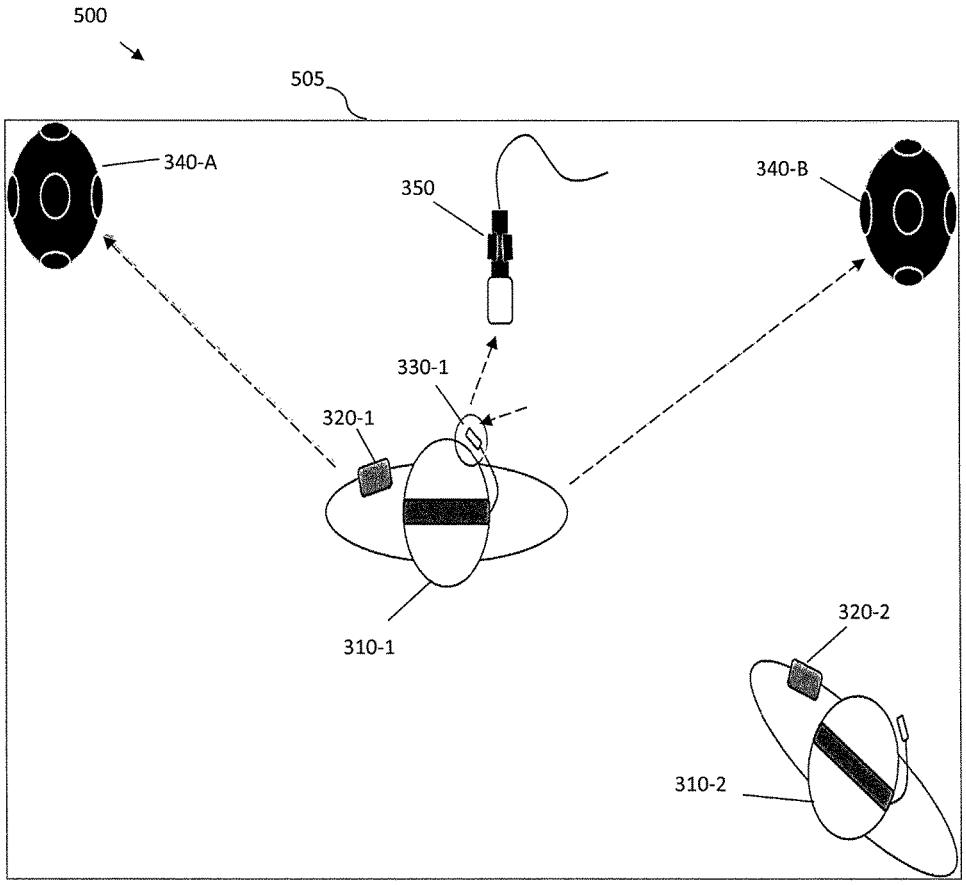
FIG. 5 is an example illustration of a user employing superzoom.

Referring also to FIG. 5, an example illustration 500 of a user employing superzoom is shown.

As shown in FIG. 5, a user, such as user 410 described hereinabove with respect to FIG. 4, may initiate an audio superzoom towards one of the performers 310. VR audio superzoom system 140 may implement superzoom to create an audio scene 505 (for example, a zoomed audio scene) consisting of audio only from one performer 310 (in this instance performer 310-1). The audio scene 505 may be created from audio captured from all microphones capturing the performer 310-1.

Figure 6:
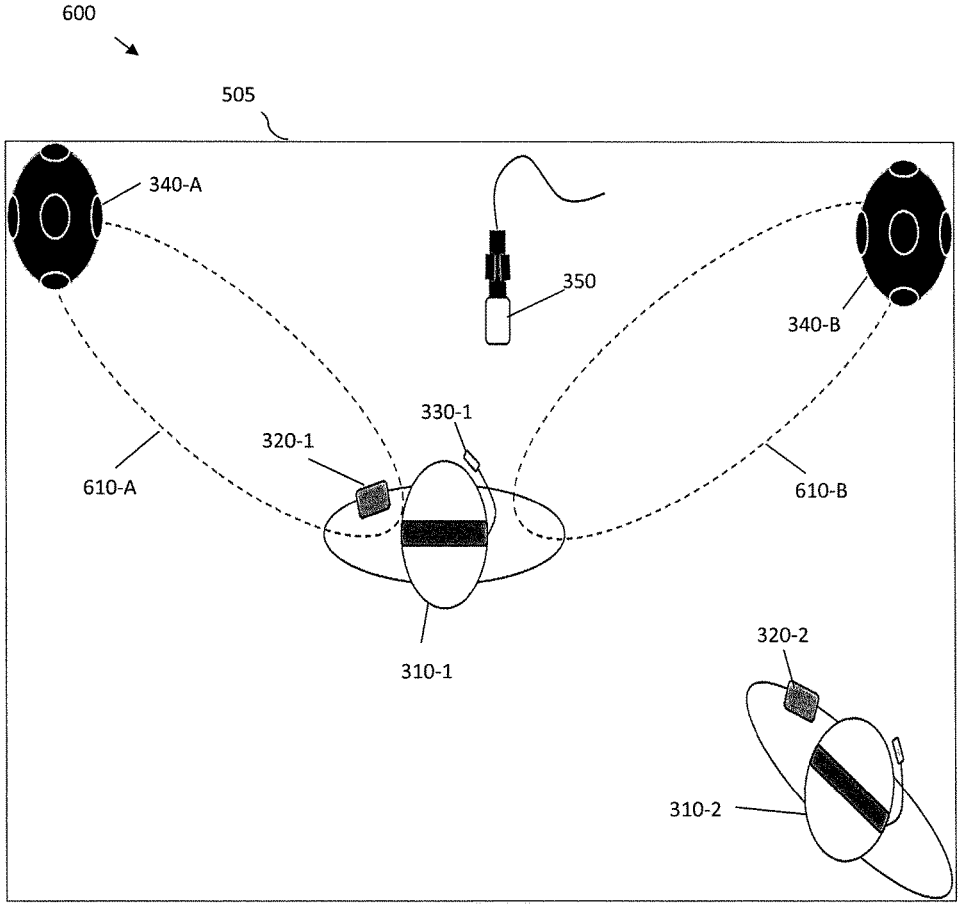
FIG. 6 is an example illustration of beamforming performed towards a selected performer.
Figure 7:
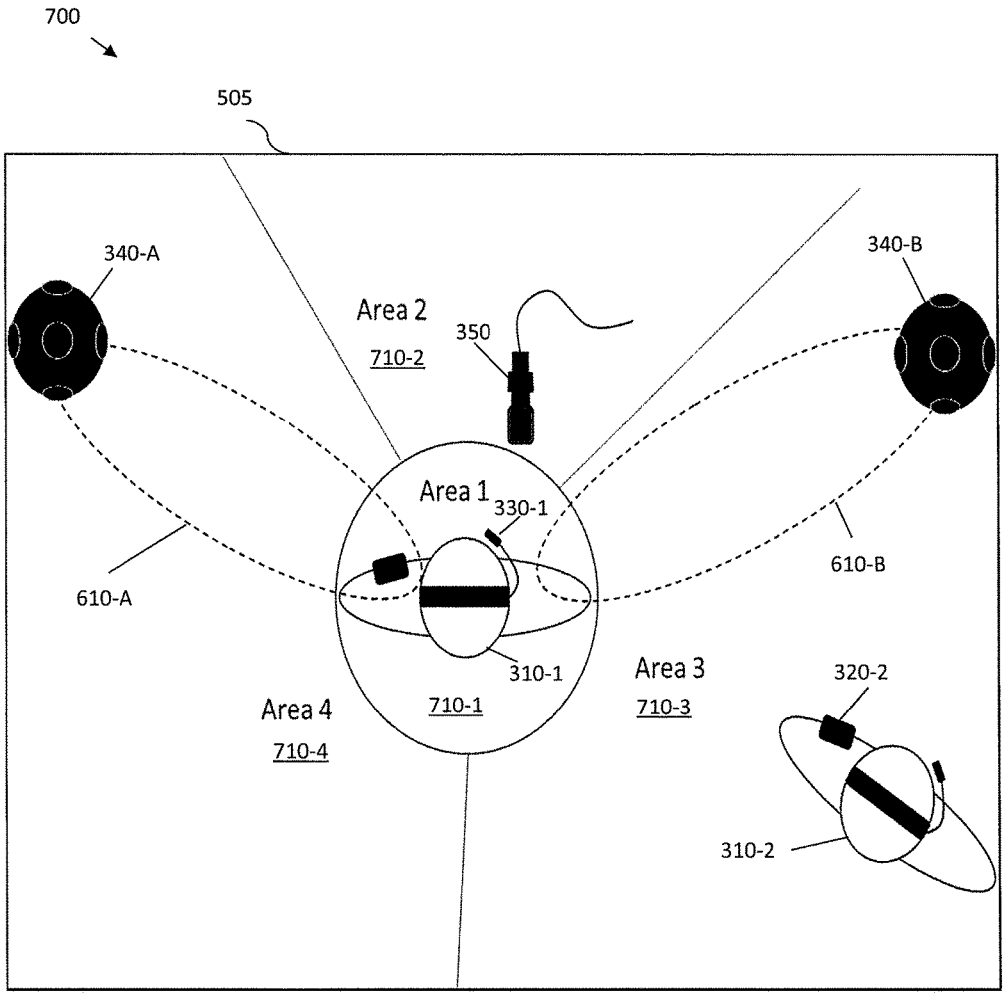
FIG. 7 is an example illustration of an area around a selected performer divided into regions covered by different microphones.
Figure 8:
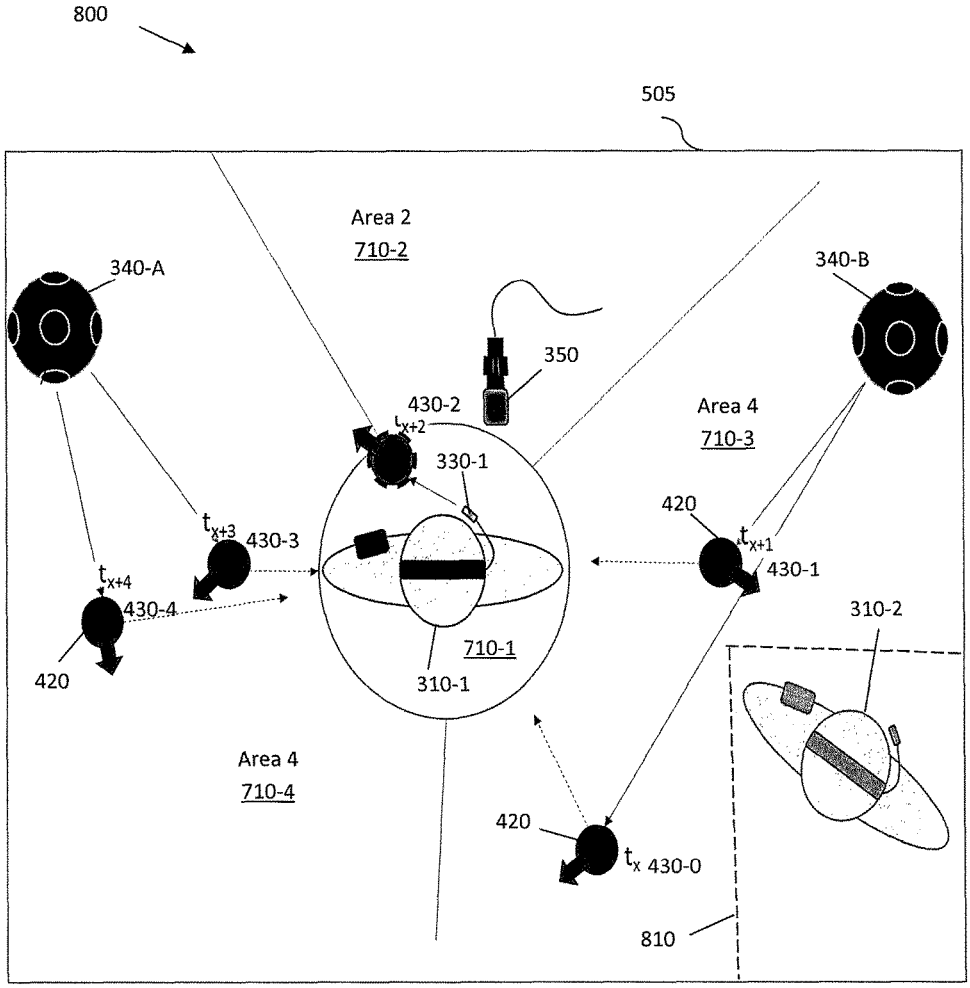
FIG. 8 is an example illustration of a user moving in the scene in which the user receives audio recorded from different microphones in their respective areas.

In FIG. 5, the user may have indicated that the user 410 wants to monitor the audio from one of the performers 310 more closely. For example, the user 410 may have provided an indication to VR audio superzoom system 140. VR audio superzoom system 140 may create an audio scene 505 for the selected performer 310-1 using the audio from microphones (330-1, 340-A, 340-B, and 350) capturing the selected person. In this example, the audio scene 505 may be created based on the performer's 310-1 own Lavalier microphone 330-1 and the microphone arrays (340-Ab and 340-B) and the stage mic 350. In this instance, (audio from) the other performer's 310-2 Lavalier microphone 330-2 may not be used (to create the audio scene 505). FIGS. 6 to 8 describe how the (zoomed) audio scene 505 is created.

FIG. 6 is an example illustration 600 of beamforming towards a selected performer 310. The beamforming may be performed for all microphones that are capable of beamforming in the scene 505 (for example, microphone arrays, such as microphone arrays 340-A and 340-B). The beamforming direction may be determined from known microphone 340 and performer 310 positions and orientations.

VR audio superzoom system 140 may implement processes to zoom in on one of the performers only, and may perform beamforming or audio focus towards a particular performer (in this instance 310-1) if the arrangement allows (see FIG. 6). VR audio superzoom system 140 may thereby focus on the audio from the performer 310-1 only. In this example, two arrays of microphones 340 (such as, for example, VR or AR cameras which include microphone arrays) may be used to receive the audio. VR audio superzoom system 140 may perform beamforming (610-A and 610-B) towards the selected performer 310-1 from the microphones (340-A and 340-B) based on the known positions and orientations of microphones (340-A and 340-B) and performers 310.

Referring also to FIG. 7, an example illustration 700 of areas around a selected performer that are divided into regions covered by the different microphones, is shown.

As shown in FIG. 7, the audio scene 505 may be divided into different areas that are covered by different microphones. Area 1 710-1 includes an area around the performer 310-1 in which a lavalier microphone 330-1 covers the corresponding region. Area 2 710-2 may include an area covered by the stage mic 350. Area 3 710-3 and Area 4 710-4 may include areas covered respectively by microphone arrays 340-B and 340-A.

VR audio superzoom system 140 may determine separate areas associated with each of the plurality of microphones, and determine a border between each of the separate areas.

Referring also to FIG. 8 an illustration 800 of a user moving (for example, walking around) in a scene 505 in which the user hears audio recorded from the different microphones when in their respective areas is shown.

Referring back to FIG. 7, VR audio superzoom system 140 may create (or identify) areas (710-1 to 710-4) that are covered by the different microphones (330-1, 340-A, 340-B, 350). The areas may be used to define which microphone signals are heard from which position when listening to each of the performers (see, for example, FIG. 8).

In FIG. 8, at time tx (430-0), the user may hear the beamformed (towards the performer) audio from the microphone (or microphone array) 340-B on the right such that it is played from the direction of the performer 310-1 (with respect to the listener or listening position 420). VR audio superzoom system 140 may be directed to not receive audio from the second performer 310-2 within a particular area 810.

Furthermore, in some instances, a microphone may be associated with a particular sound source on an object (for example, a particular location of a performer). For example, the audio signal captured by a lavalier microphone close to the mouth of a performer may be associated with the mouth of the performer (for example, microphone 330-1 on performer 310-1). The beamformed sound captured by an array (such as, for example, microphone array 340-B) further away may be associated with the whole body of the performer. In other words, one microphone may receive a sound signal associated particular section of an object of interest (OOI) and another microphone may receive a sound signal associated with the entire OOI.

When the user/listener 410 (for example, based on a user listening position 420) gets closer to the source of the audio (for example, mouth of the performer), the user 410 may hear the sound captured by the Lavalier microphone 330-1 in a greater proportion to the audio of the array associated to the full body of the performer. In other words, the area associated with sound on an object may increase in proportion (and specificity, for example, with respect to other sound sources on the performer) as the listening position associated with the user approaches the particular area of the performer. VR audio superzoom system 140 may increase a proportion of the sound signal associated with a particular section of the OOI in relation to a sound signal associated with the entire OOI in response to the user moving closer to the particular section of the OOI.

Figure 9:
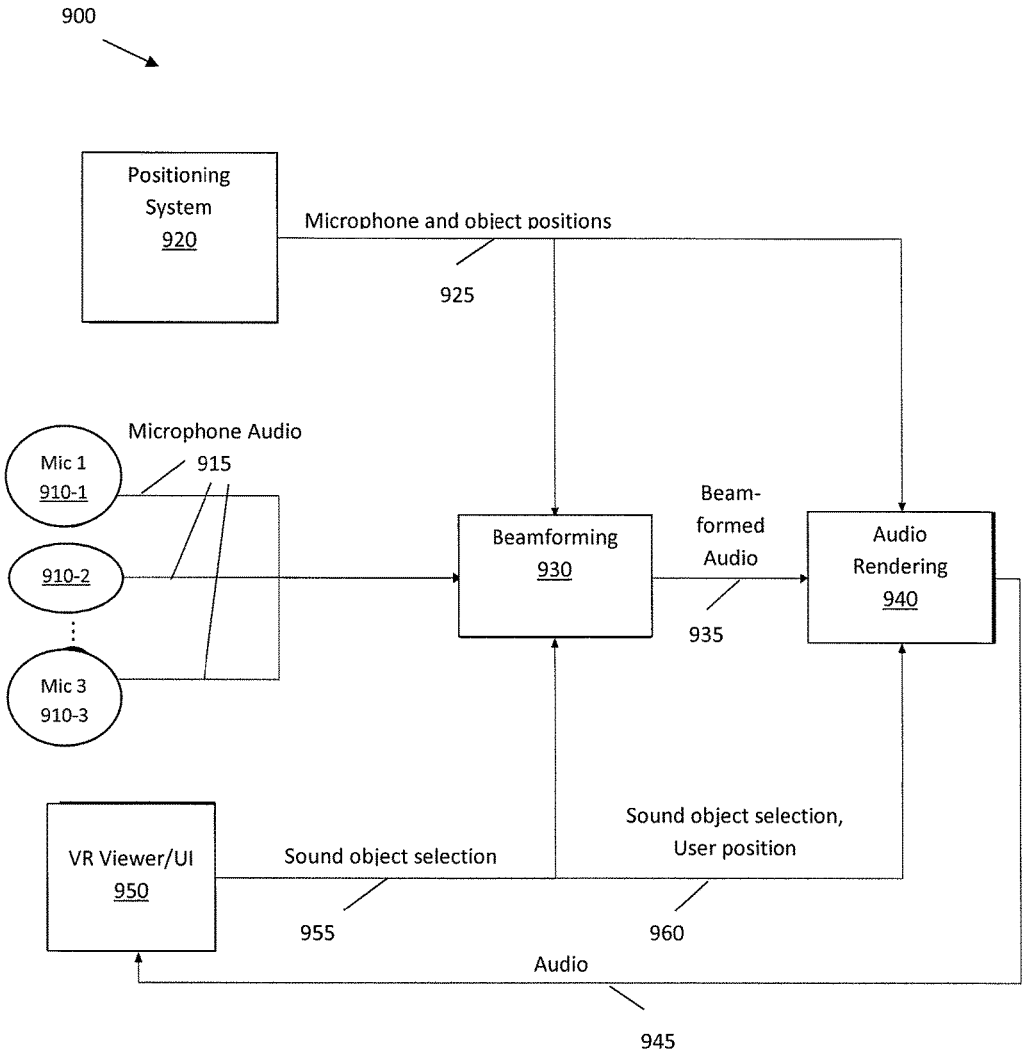
FIG. 9 is an example illustration of a block diagram of a system.

FIG. 9 is a block diagram 900 illustrating different parts of VR audio superzoom system 140.

As shown in FIG. 9, VR audio superzoom system 140 may include a plurality of mics (shown in FIG. 9 as mic 1 to mic N), a positioning system 920, a beamforming component 930, an audio rendering component 940, and a VR viewer/user interface (UI) 950.

The Mics 910 may include different microphones (for example lavalier microphones 330-1, microphone arrays 340-A, 340-B, stage mics 350, etc.), such as described hereinabove with respect to FIGS. 3-8.

Positioning system 920 may determine (or obtain) position information (for example, microphone and object positions) 925 for the performers (for example, performers 310-1 and 310-2) and microphones may be obtained using, for example, radio-based positioning methods such as High Accuracy Indoor Positioning (HAIP). HAIP tags (for example positioning tag 320-1, described hereinabove with respect to FIG. 3) may be placed on the performers (for example, 310-1 and 310-2) and the microphones (330-1, 330-2, 340-A, 340-B, 350, etc.). The HAIP locator antennas may be placed around the scene 505 to provide Cartesian (for example, x, y, z axes) position information for all tagged objects. Positioning system 920 may send the positioning information to a beamformer 930 to allow for beamforming from a microphone array towards a selected performer.

Microphone audio 915 may include the audio captured by (some or all of) the microphones recording the scene 505. Some microphones may be microphone arrays, for example microphone arrays 340-A and 340-B, providing more than one audio signal. The audio signals for the microphones may be sent (for example, bussed) to the beamforming block 930 for beamforming purposes.

VR viewer/UI 950 may allow a user of VR audio superzoom system 140 to consume the VR content captured by the cameras and microphones using a VR viewer (a head-mounted display (HMD), for example). The UI shown in the HMD may allow the user to select an object 955 in the scene 505 (a performer, for example) for which VR audio superzoom system 140 may perform an audio zoom.

Beamforming component 930 may perform beamforming towards a selected audio object (from VR viewer/UI 950) from all microphone arrays (for example, 340-A and 340-B) recording the scene 505. The beamforming directions may be determined using the microphone and object positions 925 obtained from the positioning system 920. Beamforming may be performed using processes, such as described hereinabove with respect to FIG. 7, to determine beamformed audio 935. For Lavalier and other non-microphone array microphones (for example, microphones 320-1, 302-2 and 350), the audio may be passed through beamforming block 930 untouched.

Audio rendering component 940 may receive microphone and object positions 925, beamformed audio 935 (and non-beamformed audio from Lavalier and other non-microphone array microphones), and sound object selection and user position 960 and determine an audio rendering of the scene 505 based on the inputs.

Figure 10:
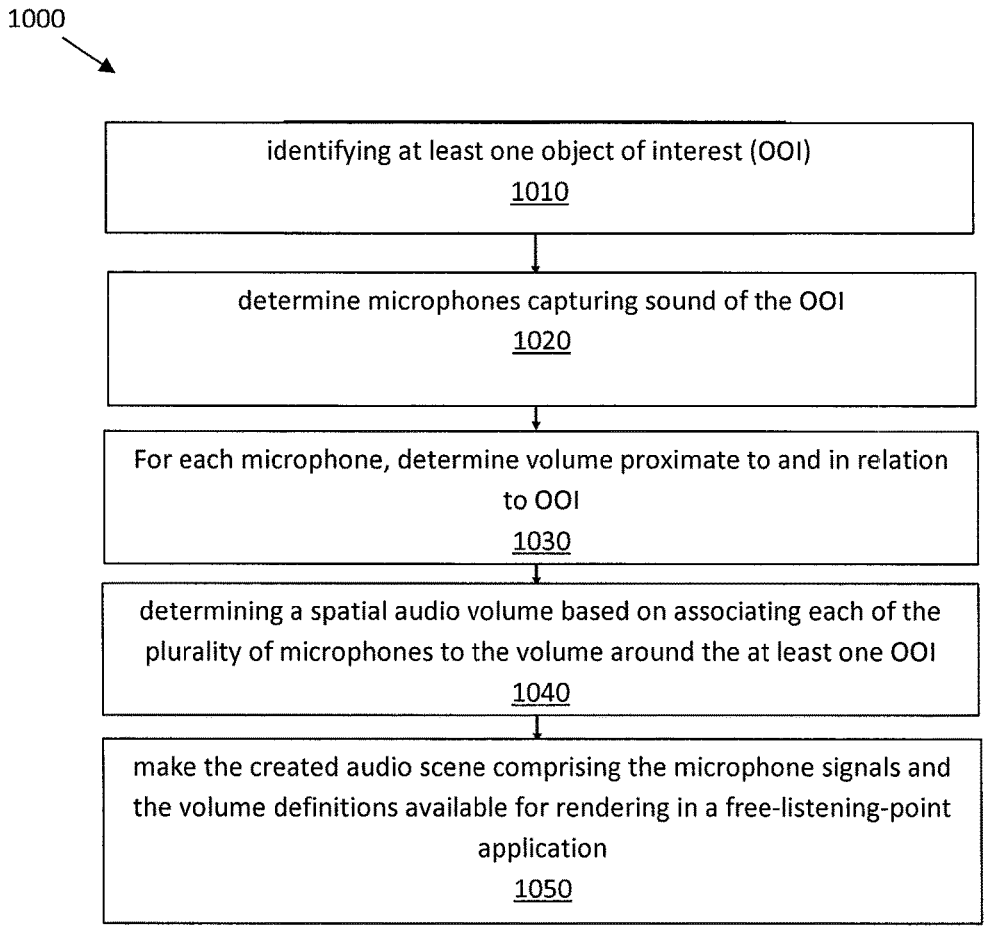
FIG. 10 is an example illustration of a flow diagram of the audio capture method.

FIG. 10 is an example flow diagram 1000 illustrating an audio capture method.

At block 1010, VR audio superzoom system 140 may identify at least one object of interest (OOI). For example, VR audio superzoom system 140 may receive an indication of an object of interest (OOI). The indication may be provided from the UI of a device, or VR audio superzoom system 140 may automatically detect each object in the scene 505 and indicate each object one at a time as an OOI for processing as described below.

VR audio superzoom system 140 may determine microphones capturing the sound of the OOI at block 1020. More particularly, VR audio superzoom system 140 may select, for the creation of the object-specific audio scene, only microphones which are actually capturing audio from the selected object. VR audio superzoom system 140 may determine the microphones by performing cross-correlation (for example, generalized cross correlation with phase transform (GCC-PHAT), etc.) between a Lavalier microphone associated with the object (for example, worn by the performer) and the other microphones. In other words, VR audio superzoom system 140 may perform cross-correlation between a microphone in close proximity to the OOI and each of the others of the plurality of microphones. If a high enough correlation value between the Lavalier signal and another microphone signal is achieved (for example, based on a predetermined threshold), the microphone may be used in the audio scene generation. VR audio superzoom system 140 may change the set of microphones selected over time as the performer moves in the scene. In instances in which no Lavalier microphones are present, VR audio superzoom system 140 may use a distance threshold to select the microphones. Microphones that are too far away from the object may be disregarded (and/or muted).

According to an example embodiment, in instances in which there are no Lavalier microphones available, VR audio superzoom system 140 may use whatever microphones are available for capturing the sound of the object, for example, microphones proximate to the object.

At block 1030, VR audio superzoom system 140 may, for each microphone capturing the sound of the OOI, determine a volume (or an area, or a point) proximate to and in relation to the OOI. VR audio superzoom system 140 may determine a volume in space around the OOI. According to an example embodiment, the volume in space may relate (for example, correspond or be determined in proportion) to the portion of the object which the particular microphone captures. For example, for Lavalier microphones close to a particular sound source of an object (for example, a mouth of a performer), the spatial volume may be a volume around the mouth of the OOI. For example, a circle with a set radius (for example, of the order of 50 cm) around the object (or, in some cases very close to the mouth). For beamformed spatial audio arrays the volume may be a spatial region around the OOI, at an orientation towards the microphone array. For example, the area may be a range of azimuth angles from the selected object. The azimuth range borders may be determined (or received) based on a direction of microphones with respect to selected object. VR audio superzoom system 140 may set the angle range borders at the midpoint between adjacent microphone directions (see, for example, FIG. 7).

VR audio superzoom system 140 may associate each microphone signal to a region in the volume which the microphone most effectively captures. For example, VR audio superzoom system 140 may associate the Lavalier mic signal to a small volume around the microphone in instances in which the Lavalier signal captures a portion of the object at a close proximity, whereas a beamformed array capture may be associated to a larger spatial volume around the object, and from the orientation towards the array.

At block 940, VR audio superzoom system 140 may determine a spatial audio volume based on associating each of the plurality of microphones to the volume around the at least one OOI.

At block 1050, VR audio superzoom system 140 may make the created audio scene comprising the microphone signals and the volume definitions available for rendering in a free-listening-point application. VR audio superzoom system 140 may provide the created audio scene comprising the microphone signals and the volume definitions for rendering in a free-listening-point application. For example, VR audio superzoom system 140 may perform data streaming, or storing the data for access by the free-listening-point application. The created audio scene may include a volumetric audio scene relating to and proximate to a single sound object appearing in a volumetric (for example, six-degrees-of-freedom, 6DoF, etc.) audio scene.

According to an example, VR audio superzoom system 140 may determine a superzoom audio scene, in which the superzoom audio scene enables a volumetric audio experience that allows the user to experience an audio object at different levels of detail, and as captured by different devices and from at least one of a different location and a different direction. VR audio superzoom system 140 may obtain a list of object positions (for example, from an automatic object position determiner and/or tracker or metadata, etc.).

Referring back to FIG. 9, audio rendering component 940 may input the beamformed audio 935, and microphone and object positions 925 to render a sound scene around the selected object 960 (performer). Audio rendering component 940 may determine, based on the microphone and selected object position, an area which each of the microphones are associated to during the capture process.

VR audio superzoom system 140 may use the determined areas in rendering to render the audio related to the selected object. The (beamformed) audio from a microphone may be rendered whenever the user is in the area corresponding to the microphone. Whenever the user crosses a border between areas, the microphone whose audio is being rendered may be changed. According to an alternative embodiment, VR audio superzoom system 140 may perform mixing of two or more microphone audio signals near the area borders. At the area border, the mixing ration between two microphones may in this instance be 50:50 (or determined with an increasing proportion of the entered area as the user moves away from the area border). At the center of the areas, only a single microphone may be heard.

The VR audio superzoom system may provide technical advantages and/or enhance the end-user experience. For example, the VR audio superzoom system may enable a volumetric, immersive audio experience by allowing the user to focus to different aspects of audio objects.

Another benefit of VR audio superzoom system is to enable the user to focus towards an object from multiple directions, and to move around an object to hear how the object sounds from different perspectives and when captured by different capturing devices in contrast with a conventional audio focus (in which the user may just focus on the sound of an individual object from a single direction). VR audio superzoom system may allow capturing and rendering an audio experience in a manner that is not possible with background immersive audio solutions. In some instances, VR audio superzoom system may allow the user to change the microphone signal(s) used for rendering the sound of an object by moving around (for example, in six degrees of freedom, etc.) an object. Therefore, the user may be able to listen to how an object sounds when captured by different capture devices from different locations and/or from different directions.

In accordance with an example, a method may include identifying at least one object of interest (OOI), determining a plurality of microphones capturing sound from the at least one OOI, determining, for each of the plurality of microphones, a volume around the at least one OOI, determining a spatial audio volume based on associating each of the plurality of microphones to the volume around the at least one OOI, and generating a spatial audio scene based on the spatial audio volume for free-listening-point audio around the at least one OOI.

In accordance with the example embodiments as described in the paragraphs above, generating a superzoom audio scene, wherein the superzoom audio scene enables a volumetric audio experience that allows a user to experience the at least one OOI at different levels of detail, and as captured by different devices and from at least one of a different location and a different direction.

In accordance with the example embodiments as described in the paragraphs above, generating a sound of the at least one OOI from a plurality of different positions.

In accordance with the example embodiments as described in the paragraphs above, wherein the spatial audio scene further comprises a volumetric six-degrees-of-freedom audio scene.

In accordance with the example embodiments as described in the paragraphs above, wherein the plurality of microphones includes at least one of a microphone array, a stage microphone, and a Lavalier microphone.

In accordance with the example embodiments as described in the paragraphs above, determining a distance to a user and a direction to the user associated with the at least one OOI.

In accordance with the example embodiments as described in the paragraphs above, performing, for at least one of the plurality of microphones, beamforming from the at least one OOI to a user.

In accordance with the example embodiments as described in the paragraphs above, wherein determining, for each of the plurality of microphones, the volume around the at least one OOI further comprise determining separate areas associated with each of the plurality of microphones, and determining a border between each of the separate areas.

In accordance with the example embodiments as described in the paragraphs above, wherein the plurality of microphones includes at least one microphone with a sound signal associated particular section of the at least one OOI and at least one other microphone with a sound signal associated with an entire area of the at least one OOI.

In accordance with the example embodiments as described in the paragraphs above, increasing a proportion of the sound signal associated with the particular section of the at least one OOI in relation to the sound signal associated with the entire area of the at least one OOI in response to a user moving closer to the particular section of the at least one OOI.

In accordance with the example embodiments as described in the paragraphs above, determining a position for each of the plurality of microphones based on a high accuracy indoor positioning tag.

In accordance with the example embodiments as described in the paragraphs above, wherein determining the plurality of microphones capturing sound from the at least one OOI further comprises performing cross-correlation between a microphone in close proximity to the at least one OOI and each of the others of the plurality of microphones.

In accordance with the example embodiments as described in the paragraphs above, wherein identifying the at least one object of interest (OOI) is based on receiving an indication from a user.

In accordance with the example embodiments as described in the paragraphs above, wherein generating the spatial audio scene further comprises at least one of storing, transmitting and streaming the spatial audio scene.

In accordance with another example, an example apparatus may comprise at least one processor; and at least one non-transitory memory including computer program code, the at least one memory and the computer program code configured to, with the at least one processor, cause the apparatus to: identify at least one object of interest (OOI), determine a plurality of microphones capturing sound from the at least one OOI, determine, for each of the plurality of microphones, a volume around the at least one OOI, determine a spatial audio volume based on associating each of the plurality of microphones to the volume around the at least one OOI, and generate a spatial audio scene based on the spatial audio volume for free-listening-point audio around the at least one OOI.

In accordance with another example, an example apparatus may comprise a non-transitory program storage device, such as memory 250 shown in FIG. 2 for example, readable by a machine, tangibly embodying a program of instructions executable by the machine for performing operations, the operations comprising: identifying at least one object of interest (OOI), determining a plurality of microphones capturing sound from the at least one OOI, determining, for each of the plurality of microphones, a volume around the at least one OOI, determining a spatial audio volume based on associating each of the plurality of microphones to the volume around the at least one OOI, and generating a spatial audio scene based on the spatial audio volume for free-listening-point audio around the at least one OOI.

In accordance with another example, an example apparatus comprises: means for identifying at least one object of interest (OOI), means for determining a plurality of microphones capturing sound from the at least one OOI, means for determining, for each of the plurality of microphones, a volume around the at least one OOI, means for determining a spatial audio volume based on associating each of the plurality of microphones to the volume around the at least one OOI, and means for generating a spatial audio scene based on the spatial audio volume for free-listening-point audio around the at least one OOI.

Any combination of one or more computer readable medium(s) may be utilized as the memory. The computer readable medium may be a computer readable signal medium or a non-transitory computer readable storage medium. A non-transitory computer readable storage medium does not include propagating signals and may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. A method comprising:

identifying at least one object of interest;

determining a plurality of microphones capturing sound from the at least one object of interest, wherein at least one of the plurality of microphones is located at a separate position from at least one other of the plurality of microphones in an environment, and wherein determining the at least one of the plurality of microphones and the at least one other of the plurality of microphones comprises determining each said respective microphone is capturing sound from the at least one object of interest relative to a microphone in close proximity to the at least one object of interest;

determining, for each said respective microphone at each of the separate positions in the environment, at least one of an area, a volume, and a point around the at least one object of interest;

determining an audio scene based on associating each of said respective microphones to the at least one of the determined area, volume, and point around the at least one object of interest; and generating the audio scene based on at least one of the determined audio scene for free-listening-point audio around the at least one object of interest.

2. The method of claim 1, wherein generating the audio scene further comprises:

generating a superzoom audio scene, wherein the superzoom audio scene enables a volumetric audio experience that allows a user to select to experience the at least one object of interest at different levels of detail, and as captured by different devices of the plurality of microphones and from at least one of a different location and a different direction than a first direction and location.

3. The method of claim 1, wherein generating the audio scene further comprises:

generating a sound of the at least one object of interest from a plurality of the separate positions.

4. The method of claim 1, wherein the audio scene further comprises a volumetric six-degrees-of-freedom audio scene.

5. The method of claim 1, wherein the plurality of microphones includes at least one of a microphone array, a stage microphone, and a Lavalier microphone.

6. The method of claim 1, generating the audio scene further comprises:

determining a distance to a user and a direction to the user associated with the at least one object of interest.

7. The method of claim 1, further comprising:

performing, for at least one of the plurality of microphones, beamforming from the at least one object of interest to a user.

8. The method of claim 1, wherein determining, for each of the plurality of microphones, the area around the at least one object of interest further comprises:

determining separate areas associated with each of the plurality of microphones; and determining a border between each of the separate areas.

9. The method of claim 1, wherein the plurality of microphones includes at least one microphone with a sound signal associated particular section of the at least one object of interest and at least one other microphone with a sound signal associated with an entire area of the at least one object of interest.

10. The method of claim 9, wherein generating the audio scene further comprises:

increasing a proportion of the sound signal associated with the particular section of the at least one object of interest in relation to the sound signal associated with the entire area of the at least one object of interest in response to a user moving closer to the particular section of the at least one object of interest.

11. The method of claim 1, further comprising:

determining a position for each of the plurality of microphones based on a high accuracy indoor positioning tag.

12. The method of claim 1, wherein determining the plurality of microphones capturing sound from the at least one object of interest further comprises:

performing cross-correlation between a microphone in close proximity to the at least one object of interest and each of the others of the plurality of microphones.

13. The method of claim 1, wherein identifying the object of interest is based on receiving an indication from a user.

14. The method of claim 1, wherein generating the audio scene further comprises:

at least one of storing, transmitting and streaming the audio scene.

15. An apparatus comprising:

at least one processor; and at least one non-transitory memory including computer program code, the at least one memory and the computer program code configured to, with the at least one processor, cause the apparatus to:

identify at least one object of interest;

determine a plurality of microphones capturing sound from the at least one object of interest, wherein at least one of the plurality of microphones is located at a separate position from at least one other of the plurality of microphones in an environment, and wherein determining the at least one of the plurality of microphones and the at least one other of the plurality of microphones comprises determining each said respective microphone is capturing sound from the at least one object of interest relative to a microphone in close proximity to the at least one object of interest;

determine, for each said respective microphone at each of the separate positions in the environment, at least one of an area, a volume, and a point around the at least one object of interest;

determine an audio scene based on associating each of said respective microphones to the at least one of the determined area, volume, and point around the at least one object of interest; and generate the audio scene based on at least one of the determined audio scene for free-listening-point audio around the at least one object of interest.

16. An apparatus as in claim 15, where, when generating the audio scene, the at least one memory and the computer program code are configured to, with the at least one processor, cause the apparatus to:

generate a superzoom audio scene, wherein the superzoom audio scene enables a volumetric audio experience that allows a user to select to experience the at least one object of interest at different levels of detail, and as captured by different devices of the plurality of microphones and from at least one of a different location and a different direction than a first direction and location.

17. An apparatus as in claim 15, wherein the plurality of microphones includes at least one of a microphone array, a stage microphone, and a Lavalier microphone.

18. An apparatus as in claim 15, where, when generating the audio scene, the at least one memory and the computer program code are configured to, with the at least one processor, cause the apparatus to:

determine a distance to a user and a direction to the user associated with the at least one object of interest.

19. An apparatus as in claim 15, where the at least one memory and the computer program code are further configured to, with the at least one processor, cause the apparatus to:

perform, for at least one of the plurality of microphones, beamforming from the at least one object of interest to a user.

20. A non-transitory program storage device readable by a machine, tangibly embodying a program of instructions executable by the machine for performing operations, the operations comprising:

identifying at least one object of interest;

determining a plurality of microphones capturing sound from the at least one object of interest, wherein at least one of the plurality of microphones is located at a separate position from at least one other of the plurality of microphones in an environment, and wherein determining the at least one of the plurality of microphones and the at least one other of the plurality of microphones comprises determining each said respective microphone is capturing sound from the at least one object of interest relative to a microphone in close proximity to the at least one object of interest;

determining, for each said respective microphone at each of the separate positions in the environment, at least one of an area, a volume, and a point around the at least one object of interest;

determining an audio scene based on associating each of said respective microphones to the at least one of the determined area, volume, and point around the at least one object of interest; and generating the audio scene based on at least one of the determined audio scene for free-listening-point audio around the at least one object of interest.

* * * * *